US010280495B2

(12) United States Patent
Kokubo et al.

(10) Patent No.: US 10,280,495 B2
(45) Date of Patent: May 7, 2019

(54) HIGH-STRENGTH ALUMINUM ALLOY FIN MATERIAL AND PRODUCTION METHOD THEREOF

(71) Applicants: DENSO CORPORATION, Aichi (JP); NIPPON LIGHT METAL COMPANY, LTD., Tokyo (JP); NOVELIS INC., Atlanta, GA (US)

(72) Inventors: Takanori Kokubo, Shizuoka (JP); Toshiya Anami, Shizuoka (JP); Hayaki Teramoto, Aichi (JP); Hideyuki Ota, Aichi (JP); Toshihide Ninagawa, Aichi (JP)

(73) Assignees: DENSO CORPORATION, Aichi (JP); NOVELIS INC., Atlanta, GA (US); NIPPON LIGHT METAL COMPANY, LTD., Tokyo (JP)

( * ) Notice: Subject to any disclaimer, the term of this patent is extended or adjusted under 35 U.S.C. 154(b) by 857 days.

(21) Appl. No.: 14/423,163

(22) PCT Filed: Jun. 4, 2013

(86) PCT No.: PCT/JP2013/065468

§ 371 (c)(1),
(2) Date: Feb. 23, 2015

(87) PCT Pub. No.: WO2014/034212

PCT Pub. Date: Mar. 6, 2014

(65) Prior Publication Data

US 2015/0252461 A1 Sep. 10, 2015

(30) Foreign Application Priority Data

Aug. 30, 2012 (JP) ..... 2012-190397

(51) Int. Cl.

| | |
|---|---|
| ***C22F 1/04*** | (2006.01) |
| ***C22C 21/00*** | (2006.01) |
| ***C22F 1/053*** | (2006.01) |
| ***C22C 21/02*** | (2006.01) |
| ***F28F 21/08*** | (2006.01) |
| ***F28F 1/12*** | (2006.01) |
| ***B22D 11/00*** | (2006.01) |
| ***C22C 21/10*** | (2006.01) |
| ***C22F 1/043*** | (2006.01) |
| *F28F 19/00* | (2006.01) |

(52) U.S. Cl.

CPC ..... *C22F 1/053* (2013.01); *B22D 11/003* (2013.01); *C22C 21/00* (2013.01); *C22C 21/02* (2013.01); *C22C 21/10* (2013.01); *C22F 1/04* (2013.01); *C22F 1/043* (2013.01); *F28F 1/126* (2013.01); *F28F 21/084* (2013.01); *F28F 19/00* (2013.01); *F28F 2275/04* (2013.01)

(58) Field of Classification Search

CPC ..... C22F 1/04; C22C 21/00; B22D 11/003
See application file for complete search history.

(56) References Cited

U.S. PATENT DOCUMENTS

| | | | | |
|---|---|---|---|---|
| 8,110,051 | B2 | 2/2012 | Oki et al. | |
| 8,142,575 | B2 | 3/2012 | Oki et al. | |
| 2007/0113936 | A1 | 5/2007 | Oki et al. | |
| 2009/0260726 | A1* | 10/2009 | Oki | B21B 1/28 148/551 |

FOREIGN PATENT DOCUMENTS

| | | | | |
|---|---|---|---|---|
| JP | 2002241910 A | | 8/2002 | |
| JP | 2002256402 A | | 9/2002 | |
| JP | 2004277756 A | | 10/2004 | |
| JP | 2005220375 A | | 8/2005 | |
| JP | 2008-038166 A | * | 2/2008 | C22C 21/00 |
| JP | 2008038166 A | | 2/2008 | |
| JP | 2009270180 A | | 11/2009 | |

OTHER PUBLICATIONS

International Search Report from PCT/JP2013/065468 dated Aug. 6, 2013.

* cited by examiner

*Primary Examiner* — George Wyszomierski
*Assistant Examiner* — Janell C Morillo
(74) *Attorney, Agent, or Firm* — Millen White Zelano and Branigan, PC; Csaba Henter

(57) ABSTRACT

An aluminum alloy fin material for heat exchanger use having a 35 to 50 μm thickness, a small springback at the time of corrugation, a suitable strength before brazing enabling easy fin formation, a high strength after brazing, and excellent erosion resistance, self corrosion resistance, and sacrificial anodic effect and a method of production of the same are provided. A fin material containing, by mass %, Si: 0.9 to 1.2%, Fe: 0.8 to 1.1%, Mn: 1.1 to 1.4%, and Zn: 0.9 to 1.1%, further limiting the impurity Mg to 0.05% or less, Cu to 0.03% or less, and ([Si]+[Fe]+2[Mn])/3 to 1.4% to 1.6%, and having a balance of unavoidable impurities and Al. A method of production prescribing hot rolling, cold rolling, intermediate annealing, and final cold rolling.

8 Claims, No Drawings

HIGH-STRENGTH ALUMINUM ALLOY FIN MATERIAL AND PRODUCTION METHOD THEREOF

TECHNICAL FIELD

The present invention relates to a high strength aluminum alloy fin material which is used for an aluminum heat exchanger and a method of production of the same.

BACKGROUND ART

As an aluminum heat exchanger, one comprised of the material forming the aluminum working fluid passages to which the material forming the aluminum alloy fins are brazed has been used. To improve the performance and characteristics of heat exchangers, this aluminum alloy fin material is required to have a sacrificial anodic effect to prevent corrosion of the material forming the working fluid passage and required to have excellent sag resistance and erosion resistance so that the fin material does not deform and the brazing material does not penetrate into the fin material due to high temperature heating at the time of brazing.

The fin material has Mn, Fe, Si, Zn, etc. added to it to satisfy the above basic properties, but recently, the production process has been improved to develop high strength aluminum alloy fins for heat exchanger use with a low tensile strength before brazing and a high tensile strength after brazing and heat conductivity.

PLT 1 discloses a method of production of an aluminum alloy fin material for brazing use which satisfies the above properties required for fin materials and provides a fin material which can be made thinner by casting an aluminum alloy melt which has a specific composition to an aluminum alloy sheet by a twin roll type continuous casting and rolling method, cold rolling it, and annealing it two times or more by intermediate annealing.

The fin material which is proposed in PLT 1 raises the braze dispersion resistance by holding the rolled structure (fibrous structure) until brazing heating. However, a fin material which is reduced in thickness tends to become larger in springback. When made corrugated, there was the concern that a predetermined fin pitch could no longer be obtained.

PLT 2 discloses an aluminum alloy fin material which contains Si: 0.7 to 1.3 wt %, Fe: over 2.0 wt % to 2.8 wt %, Mn: over 0.6 wt % to 1.2 wt %, and Zn: over 0.02 wt % to 1.5 wt %, has a balance of Al and unavoidable impurities, has 110,000/mm$^2$ or more intermetallic compounds with maximum sizes of 0.1 to 1.0 μm, and has a grain size after brazing of 150 μm or more.

The fin material which is described in PLT 2 has an electrical conductivity after brazing of 50% IACS or more and an excellent heat conductivity, but even if Fe is over 2.0 wt % to 2.8 wt % and the solidification cooling speed is relatively fast as with a twin belt casting machine, coarse Al—(Fe.Mn)—Si-based precipitates are formed at the time of casting and production of a sheet material is liable to become difficult.

PLT 3 discloses a method of production of an aluminum alloy fin material for brazing use which satisfies the above properties required for fin materials and provides a fin material which can be made thinner by casting an aluminum alloy melt which has a specific composition to an aluminum alloy slab by a twin belt type continuous casting method, cold rolling it, and annealing it by intermediate annealing.

Further, the fin material for a heat exchanger is formed into a predetermined shape by corrugation etc. before brazing the fin material with other members of the heat exchanger. At this time, the high hardness second phase particles which are present in the metal structure of the fin material promote the abrasion of the shaping mold and the lifetime of the mold become shorter.

PLT 4 discloses the art in which the number of 1 μm or more second phase particles per unit area present in the metal structure of the fin material is defined so as to improve the mold wear characteristic.

However, if trying to further reduce the thickness of a fin material and raise the tensile strength of a fin material, there has been the concern for springback easily occurring at the time of corrugation and the formability falling like in the past.

CITATIONS LIST

Patent Literature

PLT 1: Japanese Patent Publication No. 2002-241910A
PLT 2: Japanese Patent Publication No. 2004-277756A
PLT 3: Japanese Patent Publication No. 2008-038166A
PLT 4: Japanese Patent Publication No. 2009-270180A

SUMMARY OF INVENTION

Technical Problem

An object of the present invention is to provide a thin aluminum alloy fin material for heat exchanger use which, even if made thinner to a final sheet thickness of 35 to 50 μm, has little springback at the time of corrugation, has suitable strength before brazing enabling easy fin formation, has a high strength after brazing, and is excellent in erosion resistance, self corrosion resistance, and sacrificial anodic effect and a method of production of the same.

Solution to Problem

The inventors etc. engaged in intensive studies and as a result discovered that by limiting the alloy composition to a suitable range and devising a method of production comprising using a continuous thin slab casting machine to cast a thin slab and suitably combining hot rolling, cold rolling, and annealing under prescribed conditions, it is possible to obtain an aluminum alloy fin material for heat exchanger use which, even if made thinner to a final sheet thickness of 35 to 50 μm, is suppressed in springback at the time of corrugation, is excellent in formability, and has the above properties and to obtain a method of production of the same.

That is, to achieve the above object, according to the present invention, there is provided an aluminum alloy fin material for heat exchanger use containing, by mass %, Si: 0.9 to 1.2%, Fe: 0.8 to 1.1%, Mn: 1.1 to 1.4%, and Zn: 0.9 to 1.1%, further limiting the impurity Mg to 0.05% or less, Cu to 0.03% or less, and concentration of content of ([Si] F[Fe]+2[Mn])/3 to 1.4% to 1.6%, and having a balance of unavoidable impurities and Al, wherein a final sheet thickness is 35 to 50 μm, a tensile strength before brazing is 215 MPa or less, a solidus temperature is 620° C. or more, a tensile strength after brazing is 140 MPa or more, an electrical conductivity after brazing is 45% IACS or more, and a rest potential after brazing is −730 mV to −760 mV.

Further, a method of production for a fin material of the present invention (first method of production) comprises pouring a melt of the composition described above, using a thin slab continuous casting machine to continuously cast a thickness 3 to 20 mm thin slab, using a hot rolling mill to roll the thin slab to 0.5 to 5 mm, winding it up in a roll, then cold rolling it to a sheet thickness of 0.05 to 0.1 mm, annealing it at a holding temperature of 250 to 450° C. for intermediate annealing, and cold rolling it with a final cold rolling rate of 25 to 50% to a final sheet thickness of 35 to 50 μm.

Furthermore, a method of production for a fin material of the present invention (second method of production) comprises pouring a melt of the composition described above, using a thin slab continuous casting machine to continuously cast a thickness 3 to 10 mm thin slab, winding it up in a roll, then cold rolling it as a first stage to a sheet thickness of 1.0 to 6.0 mm, annealing it at 300 to 500° C. for primary intermediate annealing, further cold rolling it as a second stage to a sheet thickness of 0.05 to 0.1 mm, annealing it at 250 to 450° C. for secondary intermediate annealing, and cold rolling it with a final cold rolling rate of 25 to 50% to a final sheet thickness of 35 to 50 μm.

Advantageous Effects of Invention

The aluminum alloy fin material for heat exchanger use of the present invention features, as a characteristic of the chemical composition, limitation of the concentration of content of ([Si]+[Fe]+2[Mn])/3 to 1.4% to 1.6% compared with a conventional fin material to thereby obtain a thin fin material which even if made thinner to a final sheet thickness of 35 to 50 μm, has little springback at the time of corrugation, has suitable strength before brazing enabling easy fin formation, has a high strength after brazing, and is excellent in erosion resistance, self corrosion resistance, and sacrificial anodic effect.

The method of production for the fin material of the present invention can produce a fin material which is provided with the above conditions by using a melt of the composition of the fin material of the present invention to cast a thin slab by a continuous thin slab casting machine and suitably combining hot rolling, cold rolling, and annealing under prescribed conditions.

DESCRIPTION OF EMBODIMENTS

The reasons for limitation of the composition of the aluminum alloy fin material for heat exchanger use of the present invention will be explained. In this Description, unless indicated in particular otherwise, the "%" indicating content means "mass %".

Si: 0.9 to 1.2%

Si forms submicron-level Al—(Fe.Mn)—Si-based compounds in the copresence of Fe and Mn at the time of brazing to improve the strength and simultaneously decreases the amount of solid solution of Mn to improve the heat conductivity. If the concentration of content of Si is less than 0.9%, the effect is not sufficient. If over 1.2%, the solidus temperature falls, so the possibility of erosion of the fin material at the time of brazing rises. Therefore, the concentration of content of Si is limited to 0.9 to 1.2%. Preferably, the concentration of content of Si is 0.95 to 1.15% in range. More preferably, the concentration of content of Si is 0.95% to 1.1% in range.

Fe: 0.8 to 1.1%

Fe forms submicron-level Al—(Fe.Mn)—Si-based compounds in the copresence of Mn and Si at the time of brazing to improve the strength and simultaneously decreases the amounts of solid solution of Si and Mn to make the potential low and improve the conductivity (heat conductivity). To obtain this effect, a concentration of content of Fe of 0.8% or more is necessary. If the concentration of content of Fe is less than 0.8%, not only does the strength fall, but also the rest potential after brazing is made low, the effect of improvement of the sacrificial anodic effect falls, and the conductivity also falls. However, if the concentration of content of Fe is over 1.1%, the tensile strength before brazing becomes too high, springback cannot be suppressed, and the formability falls. Therefore, the concentration of content of Fe is limited to 0.8 to 1.1%. The preferable concentration of content of Fe is 0.85 to 1.05%. The more preferable concentration of content of Fe is 0.9 to 1.0%.

Mn: 1.1 to 1.4%

Mn precipitates in a high density as a submicron level Al—(Fe.Mn)—Si-based compound at the time of brazing due to the copresence of Fe and Si and improves the strength of the alloy material after brazing. Further, the submicron level Al—(Fe.Mn)—Si-based precipitate has a strong effect of inhibiting recrystallization, so the recrystallized particles become 200 μm or more and erosion resistance can be secured. To obtain this effect, the concentration of content of Mn has to be 1.1% or more. However, if the concentration of content of Mn is over 1.4%, the tensile strength before brazing becomes too high, springback cannot be suppressed, and the formability falls. Therefore, the concentration of content of Mn is limited to 1.1 to 1.4%. The preferable concentration of content of Mn is 1.2 to 1.4%. The more preferable concentration of content of Mn is 1.2 to 1.35%.

Zn: 0.9 to 1.1%

Zn makes the rest potential after brazing of the fin material low, so gives a sacrificial anodic effect. To obtain this effect, a concentration of content of Zn of 0.9% or more is necessary. However, if the concentration of content of Zn is over 1.1%, the self corrosion resistance of the material deteriorates and the heat conductivity falls due to the solid solution of the Zn. Therefore, the concentration of content of Zn is limited to 0.9 to 1.1%. The preferable concentration of content of Zn is 0.95 to 1.1%. The more preferable concentration of content of Zn is 0.95 to 1.05%.

Mg: 0.05 wt % or less

Mg affects the brazeability. If the concentration of content exceeds 0.05 wt %, the brazeability is liable to be impaired. In particular, in the case of brazing using a fluoride-based flux, the fluorine (F) in the ingredients of the flux and the Mg in the alloy easily react and $MgF_2$ and other compounds are produced. For this reason, the absolute amount of the flux which effectively acts at the time of brazing becomes insufficient and poor brazeability easily occurs. Therefore, as the unavoidable impurities, in particular, the concentration of content of Mg is limited to 0.05% or less.

Concentration of Content of ([Si]+[Fe]+2[Mn])/3 Limited to 1.4% to 1.6% The aluminum alloy fin material for heat exchanger use of the present invention features, as a characteristic of the chemical composition, limitation of the concentration of content of ([Si]+[Fe]+2[Mn])/3 to 1.4% to 1.6% compared with a conventional fin material to thereby obtain a thin fin material which even if made thinner to a final sheet thickness of 35 to 50 μm, has little springback at the time of corrugation, has suitable strength before brazing enabling easy fin formation, has a high strength after brazing, and is excellent in erosion resistance, self corrosion resistance, and sacrificial anodic effect. If the concentration of ([Si]+[Fe]+2[Mn])/3 is less than 1.4%, the tensile strength of the fin material after brazing becomes less than 140 MPa and the strength after brazing becomes insufficient. Further, if the concentration of content of ([Si]+

[Fe]+2[Mn])/3 exceeds 1.6%, the tensile strength of the fin material before brazing ends up exceeding 215 MPa, so the fin formability falls.

Cu: 0.03% or less

Regarding the impurity components other than Mg, Cu makes the potential of the material high, so the content is limited to 0.03% or less. Cr, Zr, Ti, and V remarkably lower the conductivity (heat conductivity) of the material even in slight amounts, so the concentrations of content of these elements are respectively limited to 0.05% or less.

Final Sheet Thickness: 35 to 50 μm

To reduce the thickness and reduce the weight, the final sheet thickness is limited to 50 μm or less. Further, if the final sheet thickness is less than 35 μm, insufficient strength of the heat exchanger itself is invited after brazing. Therefore, the final sheet thickness of the fin material is limited to 35 to 50 μm.

Tensile Strength Before Brazing: 215 MPa or Less

If the tensile strength is over 215 MPa, in the case of a thin fin material with a sheet thickness of 35 to 50 μm, the springback at the time of fin formation becomes larger and a predetermined fin shape can no longer be obtained. Therefore, the tensile strength of the fin material is limited to 215 MPa or less.

Solidus Temperature: 620° C. or More

If the solidus temperature is less than 620° C., the possibility for erosion occurring at the time of brazing rises, so this is not preferable. Therefore, the solidus temperature is limited to 620° C. or more.

Tensile Strength After Brazing: 140 MPa or More

The fin material of the present invention is brazed to tubes etc. for use as a heat exchanger. For this reason, it is necessary to satisfy the predetermined strength required for a heat exchanger as a whole. The tensile strength after brazing is limited to 140 MPa or more.

Electrical Conductivity After Brazing: 45% IACS or More

The fin material of the present invention is brazed to tubes etc. for use as a heat exchanger. For this reason, it is necessary to transfer heat from the heat medium which flows through the insides of the tubes through the fins and efficiently radiate it. The electrical conductivity after brazing is limited to 45% IACS or more.

Rest Potential After Brazing: −730 mV to −760 mV

The "rest potential" in the present application means the potential based on a silver-silver chloride reference electrode (SSE: Ag/AgCl/5% NaCl aqueous solution). If the rest potential after brazing is over −730 mV, the potential becomes too high and the fin material falls in sacrificial anodic effect, so this is not preferable. Further, if the rest potential after brazing is less than −760 mV, the potential becomes too low and the fin material falls in self-corrosion resistance, so this is not preferable. Therefore, the preferable rest potential after brazing is −730 mV to −760 mV in range. The more preferable rest potential after brazing is −740 mV to −760 mV in range.

Next, the meanings and reasons for limitation of the casting conditions, intermediate annealing conditions, final cold rolling rate, and final annealing conditions of the thin slab in the present invention will be explained below.

Use of Thin Slab Continuous Casting Machine

The thin slab continuous casting machine is made one which includes both a twin belt casting machine and a twin roll casting machine. The twin belt casting machine is provided with a pair of rotating belt parts which are provided with endless belts and face each other top and bottom, a cavity which is formed between the pair of rotating belt parts, and cooling means which are provided inside the rotating belt parts and continuously casts a thin slab by supply of metal melt into the cavity through nozzles comprised of a refractory. The twin roll casting machine is provided with a pair of rotating roll parts which are provided with endless rolls and face each other top and bottom, a cavity which is formed between the pair of rotating roll parts, and cooling means which are provided inside the rotating roll parts and continuously casts a thin slab by supply of metal melt into the cavity through nozzles comprised of a refractory.

The first method of production uses a thin slab continuous casting machine to continuously cast a thickness 3 to 20 mm thin slab, uses a hot rolling mill to roll it, winds it up into a roll, then cold rolls it to a sheet thickness of 0.05 to 0.1 mm, anneals it at a holding temperature 250 to 450° C. for intermediate annealing, and cold rolls it with a cold rolling rate of 25 to 50% to obtain a final sheet thickness of 35 to 50 μm.

Slab Thickness: 3 to 20 mm

In the first method of production, the thickness of the cast slab is limited to 3 to 20 mm. If the thickness is in this range, the speed of solidification at the center part in the sheet thickness is so fast that a uniform structure is formed, and in a composition in the range of the present invention, the amount of coarse compounds is small and a fin material can be obtained which has a large grain size and excellent properties after brazing. If the thin slab thickness is less than 3 mm, the amount of aluminum which passes through the continuous thin slab casting machine per unit time becomes too small and casting becomes difficult. If the thickness exceeds 20 mm, the cooling speed at the center part of sheet thickness becomes slower, coarse intermetallic compounds precipitate, and a reduction in the tensile strength of the fin material is invited. Accordingly, the slab thickness is limited to 3 to 20 mm.

When using a thin slab continuous casting machine to cast a thin slab (with a thickness of 3 to 20 mm), the slab cooling speed at a position of thin slab ¼ thickness is 20 to 1000° C./sec or so. With the melt solidifying in a relatively fast cooling speed in this way, in the range of chemical composition of the present invention, it becomes possible to suppress the precipitation of Al—(Fe.Mn)—Si and other coarse intermetallic compounds at the time of casting and becomes possible to raise the amounts of Fe, Si, Mn, and other elements forming solid solutions in the matrix.

In the first method of production, the cast thin slab is further hot rolled and then wound up in a coil. In particular, when the thickness of the cast slab is over 10 mm, unless after using a hot rolling mill to hot roll the slab to a thickness of 10 mm or less, it becomes difficult to wind up the slab into a coil. Of course, even if the cast slab thickness is 3 to 10 mm, for example, if using a hot rolling mill for skin pass rolling of a reduction rate of 5 to 10% or so, it is possible to improve the flatness of the surface and improve the surface quality of the coil.

Intermediate Annealing at Holding Temperature of 250 to 450° C.

The holding temperature of the intermediate annealing is limited to 250 to 450° C. If the holding temperature of the intermediate annealing is less than 250° C., a sufficient softened state cannot be obtained. However, if the holding temperature of the intermediate annealing is over 450° C., a large amount of Mn in solid solution in the matrix which precipitates at the time of brazing ends up precipitating as relatively large Al—(Fe.Mn)—Si-based compound at the time of high temperature intermediate annealing, so the effect in inhibiting recrystallization at the time of brazing is weakened, the recrystallized grain size becomes less than 200 μm, and the sag resistance and erosion resistance at the time of brazing fall.

The holding time of the intermediate annealing does not particularly have to be limited, but making it 1 to 5 hours in range is preferable. If the holding time of the intermediate annealing is less than 1 hour, the holding time may elapse with the temperature of the coil as a whole remaining uneven. There is a risk that a recrystallized structure cannot be obtained in the sheet, so this is not preferable. If the holding time of the intermediate annealing exceeds 5 hours, the treatment takes too much time and the productivity falls, so this is not preferable.

The temperature elevation rate and cooling speed at the time of intermediate annealing treatment does not particularly have to be limited, but making it 30° C./hour or more is preferable. If the temperature elevation rate and cooling speed at the time of intermediate annealing treatment become less than 30° C./hour, the treatment will take too much time and the productivity will fall, so this is not preferable.

Cold Rolling of Final Cold rolling Rate: 25 to 50%

The final cold rolling rate is limited to 25 to 50%. If the final cold rolling rate is less than 25%, the strain energy which is accumulated due to cold rolling is small and recrystallization is not completed in the process of temperature elevation at the time of brazing, so the sag resistance and the erosion resistance fall. If the final cold rolling rate exceeds 50%, the product strength becomes too high, the springback becomes large, and it becomes difficult to obtain a predetermined fin shape at the time of fin formation.

The second method of production is characterized by pouring a melt of the composition described above, using a thin slab continuous casting machine to continuously cast a thickness 3 to 10 mm thin slab, winding it up in a roll, then cold rolling it as a first stage to a sheet thickness of 1.0 to 6.0 mm, annealing it at 300 to 500° C. for primary intermediate annealing, further cold rolling it as a second stage to a sheet thickness of 0.05 to 0.1 mm, annealing it at 250 to 450° C. for secondary intermediate annealing, and cold rolling it with a final cold rolling rate of 25 to 50% to a final sheet thickness of 35 to 50 μm.

Slab Thickness: 3 to 10 mm

In the second method of production, the thickness of the cast slab is limited to 3 to 10 mm. If the thickness is in this range, the speed of solidification at the center part in the sheet thickness is so fast that a uniform structure is formed, and in a composition in the range of the present invention, the amount of coarse compounds is small and a fin material can be obtained which has a large grain size and excellent properties after brazing. If the thin slab thickness is less than 3 mm, the amount of aluminum which passes through the continuous thin slab casting machine per unit time becomes too small and the casting becomes difficult. If the thickness exceeds 10 mm, it becomes impossible to wind up the cast slab as it is. According, the slab thickness is limited to 3 to 10 mm.

When using a thin slab continuous casting machine to cast a thickness 3 to 10 mm thin slab, the slab cooling speed at a position of thin slab ¼ thickness is 40 to 1000° C./sec or so. With the melt solidifying in a relatively fast cooling speed in this way, in the range of chemical composition of the present invention, it becomes possible to suppress the precipitation of Al—(Fe.Mn)—Si and other coarse intermetallic compounds at the time of casting and becomes possible to raise the amounts of Fe, Si, Mn, and other elements forming solid solutions in the matrix.

In the second method of production, the cast slab thickness is 3 to 10 mm and can be wound up into a coil as it is, but, for example, it is also possible to use a hot rolling mill for skin pass rolling with a reduction rate of 5 to 10% or so. If doing this, it is possible to improve the flatness of the surface and improve the surface quality of the coil.

Primary Intermediate Annealing Conditions

The holding temperature of the primary intermediate annealing is preferably 300 to 500° C. If the holding temperature of the primary intermediate annealing is less than 300° C., a sufficient softened state cannot be obtained. If the holding temperature of the primary intermediate annealing exceeds 500° C., Mn in solid solution in the matrix ends up precipitating as an Al—(Fe.Mn)—Si-based compound at the time of intermediate annealing at a high temperature, so the effect in inhibiting recrystallization at the time of brazing is weakened, the recrystallized grain size becomes less than 200 μm, and the sag resistance and erosion resistance at the time of brazing fall.

The holding time of the primary intermediate annealing does not particularly have to be limited, but making it 1 to 5 hours in range is preferable. If the holding time of the secondary intermediate annealing is less than 1 hour, there is a possibility that the temperature of the coil as a whole will remain nonuniform and a uniform softened structure cannot be obtained, so this is not preferable. If the holding time of the primary intermediate annealing exceeds 5 hours, the treatment takes too much time and the productivity falls, so this is not preferable.

The temperature elevation rate and cooling speed at the time of primary intermediate annealing treatment do not particularly have to be limited, but making them 30° C./hour or more is preferable. If the temperature elevation rate and cooling speed at the time of primary intermediate annealing treatment are less than 30° C./hour, the treatment takes too much time and the productivity falls, so this is not preferable.

Secondary Intermediate Annealing Conditions

The holding temperature of the secondary intermediate annealing is preferably 250 to 450° C. If the holding temperature of the secondary intermediate annealing is less than 250° C., a sufficient softened state cannot be obtained. However, if the holding temperature of the secondary intermediate annealing exceeds 450° C., Mn in solid solution in the matrix ends up precipitating as an Al—(Fe.Mn)—Si-based compound at the time of intermediate annealing at a high temperature, so the effect in inhibiting recrystallization at the time of brazing is weakened, the recrystallized grain size becomes less than 200 μm, and the sag resistance and erosion resistance at the time of brazing fall.

The holding time of the secondary intermediate annealing does not particularly have to be limited, but making it 1 to 5 hours in range is preferable. If the holding time of the secondary intermediate annealing is less than 1 hour, there is a possibility that the temperature of the coil as a whole will remain nonuniform and a uniform recrystallized structure cannot be obtained, so this is not preferable. If the holding time of the secondary intermediate annealing exceeds 5 hours, the treatment takes too much time and the productivity falls, so this is not preferable.

The temperature elevation rate and cooling speed at the time of secondary intermediate annealing treatment do not particularly have to be limited, but making them 30° C./hour or more is preferable. If the temperature elevation rate and cooling speed at the time of secondary intermediate annealing treatment are less than 30° C./hour, the treatment takes too much time and the productivity falls, so this is not preferable.

Cold Rolling with Final Cold Rolling Rate of 25 to 50%

The final cold rolling rate is limited to 25 to 50%. If the final cold rolling rate is less than 25%, the strain energy which is accumulated due to cold rolling is small and recrystallization is not completed in the process of temperature elevation at the time of brazing, so the sag resistance and the erosion resistance fall. If the final cold rolling rate exceeds 50%, the product strength becomes too high, the springback becomes large, and it becomes difficult to obtain a predetermined fin shape at the time of fin formation.

This sheet material is slit to a predetermined width, then made corrugated and alternately stacked with materials for forming the working fluid passages, for example, flat tubes made of clad sheet comprised of 3003 alloy covered with a brazing material, and brazed with them to obtain a heat exchanger unit.

EXAMPLES

Example 1

Compositions of alloy 1 to alloy 10 shown in Table 1 were melted in #10 crucibles and degassed by blowing in inert gas for 5 minutes using a small-sized lance. The alloy melts were cast into inside dimension 200×200×16 mm water-cooled molds to fabricate thin slabs. The two sides of the thin slabs were ground by 3 mm each, then the slabs were cold rolled as a first stage to sheet thicknesses of 4.0 mm, were raised in temperature in the annealing furnace at a temperature elevation rate of 50° C./hr, were held at 380° C. for 2 hours, then were air cooled as primary intermediate annealing. Further, the slabs were cold rolled as a second stage to a sheet thickness of 0.08 mm, were raised in temperature in an annealing furnace with a temperature elevation rate 50° C./hr, were held at 350° C. for 2 hours, then were air cooled as secondary intermediate annealing, then were cold rolled with a cold rolling rate of 37.5% to obtain a fin material of a final sheet thickness of 50 μm (tempered: H14).

TABLE 1

| Alloy Composition of Test Material (mass %) | | | | | | | |
|---|---|---|---|---|---|---|---|
| Alloy no. | Si | Fe | Cu | Mn | Zn | Al | (Si + Fe + 2Mn)/3 |
| 1 | 1.02 | 0.96 | 0.02 | 1.30 | 1.01 | bal. | 1.53 |
| 2 | 0.79 | 0.95 | 0.02 | 1.29 | 1.00 | bal. | 1.39 |
| 3 | 1.22 | 0.95 | 0.01 | 1.30 | 1.03 | bal. | 1.57 |
| 4 | 0.97 | 0.60 | 0.01 | 1.28 | 1.03 | bal. | 1.38 |
| 5 | 1.02 | 1.29 | 0.02 | 1.30 | 1.01 | bal. | 1.64 |
| 6 | 1.02 | 0.96 | 0.01 | 0.95 | 1.02 | bal. | 1.29 |
| 7 | 1.00 | 0.96 | 0.02 | 1.56 | 1.00 | bal. | 1.69 |
| 8 | 1.04 | 0.92 | 0.02 | 1.26 | 0.54 | bal. | 1.49 |
| 9 | 1.00 | 0.99 | 0.01 | 1.34 | 1.38 | bal. | 1.56 |
| 10 | 1.01 | 0.95 | 0.05 | 1.32 | 1.02 | bal. | 1.53 |
| 11 | 0.92 | 0.87 | 0.01 | 1.19 | 1.00 | bal. | 1.39 |
| 12 | 1.01 | 1.05 | 0.02 | 1.38 | 1.06 | bal. | 1.61 |

Fin materials of compositions of the alloy 1 to alloy 12 obtained above were tested and measured as in the following (1) to (3).

(1) Tensile Strength Before Brazing Heating (MPa)

The tensile strength as measured without brazing heating.

(2) Characteristics After Brazing Heating

The following brazing heating conditions were used for heating and cooling, then the following characteristics were measured.

Brazing Heating Conditions

Envisioning the conditions of actual brazing heating, the temperature of the material was raised from room temperature for 30 minutes, was held at 600 to 605° C. for 3 minutes, then was cooled down to 200° C. by a cooling speed of 40° C./min, then was taken out from the heating furnace and cooled down to room temperature.

Test Items

[1] Tensile strength (MPa)

[2] Electrical Conductivity [% IACS]

The electrical conductivity test method described in JIS-H0505 was used to measure the electrical conductivity [% IACS] of the fin material after brazing heating.

[3] Rest Potential [mV]

Using a silver-silver chloride electrode (saturated) as the reference electrode, the rest potential (mV) after dipping in 5% saline for 60 min was measured.

(3) Measurement of Solidus Temperature

Differential thermal analysis was used to measure the solidus temperature.

Table 2 summarizes the measurement results of (1) to (3) for the fin materials of the compositions of the above alloy 1 to alloy 12.

TABLE 2

| Properties of Test Material | | | | | |
|---|---|---|---|---|---|
| | | Before brazing | After brazing | | |
| Alloy no. | Solidus temp. (° C.) | Tensile strength (MPa) | Tensile strength (MPa) | Electrical conductivity (IACS %) | Rest potential (mV) |
| 1 | 627 | 209 | 147 | 46.3 | −747 |
| 2 | 637 | 212 | 139 | 46.6 | −749 |
| 3 | 617 | 205 | 152 | 46.0 | −749 |
| 4 | 626 | 200 | 139 | 46.0 | −743 |
| 5 | 629 | 216 | 151 | 46.6 | −756 |
| 6 | 623 | 194 | 136 | 46.3 | −735 |
| 7 | 630 | 219 | 154 | 46.3 | −760 |
| 8 | 625 | 204 | 148 | 47.2 | −729 |
| 9 | 628 | 213 | 147 | 45.6 | −761 |
| 10 | 629 | 215 | 153 | 46.3 | −713 |
| 11 | 629 | 203 | 139 | 46.4 | −745 |
| 12 | 629 | 216 | 152 | 46.3 | −745 |

The fin material of the composition of the alloy 1 (invention example) was in the range of composition of the present invention, so had a solidus temperature of 620° C. or more so had a good brazeability, had a tensile strength before brazing of 215 MPa or less, had a tensile strength after brazing of 140 MPa or more, had an electrical conductivity after brazing of 45% IACS or more, and had a rest potential after brazing of −730 mV to −760 mV.

The fin material of the composition of the alloy 2 (comparative example) was too low in concentration of content of Si, so had a tensile strength after brazing of less than 140 MPa or too low.

The fin material of the composition of the alloy 3 (comparative example) was too high in concentration of content of Si, so had a solidus temperature of less than 620° C. and had an inferior brazeability.

The fin material of the composition of the alloy 4 (comparative example) was too low in concentration of content of Fe, so had a tensile strength after brazing of less than 140 MPa or too low.

The fin material of the composition of the alloy 5 (comparative example) was too high in concentration of content of Fe, so had a tensile strength before brazing of over 215 MPa or too high.

The fin material of the composition of the alloy 6 (comparative example) was too low in concentration of content of Mn, so had a tensile strength after brazing of less than 140 MPa or too low.

The fin material of the composition of the alloy 7 (comparative example) was too high in concentration of content of Mn, so had a tensile strength before brazing exceeding 215 MPa or too high.

The fin material of the composition of the alloy 8 (comparative example) was too low in concentration of content of Zn, so had a rest potential after brazing over −730 mV.

The fin material of the composition of the alloy 9 (comparative example) was too high in concentration of content of Zn, so had a rest potential after brazing below −760 mV.

The fin material of the composition of the alloy 10 (comparative example) was too high in concentration of content of Cu, so had a rest potential after brazing above −730 mV.

The fin material of the composition of the alloy 11 (comparative example) had a concentration of content of ([Si]+[Fe]+2[Mn])/3 of less than 1.4%, so had a tensile strength after brazing of less than 140 MPa or too low.

The fin material of the composition of the alloy 12 (comparative example) had a concentration of content of ([Si]+[Fe]+2[Mn])/3 of over 1.6%, so had a tensile strength before brazing of over 215 MPa or too high.

Example 2

A melt of a composition of the alloy 13 which is shown in Table 3 was cast by a twin belt casting machine to continuously cast a thin slab by a slab thickness of 17 mm. This was hot rolled by a hot rolling mill to a thickness of 1 mm, then was wound up in a coil. After that, this was cold rolled down to 0.08 mm and annealed at a holding temperature of 300° C. for intermediate annealing and cold rolled with a cold rolling rate of 44% to a final sheet thickness of 45 μm. Next, melts of compositions of alloy 14 to alloy 20 shown in Table 3 were cast by a twin belt casting machine to continuously cast thin slabs to a slab thickness of 9 mm, rolled by skin pass rolling, then wound up in coils. After that, the slabs were cold rolled as a first stage to a sheet thickness of 2.0 mm and were annealed at a holding temperature of 400° C. for primary intermediate annealing. Further, the slabs were cold rolled as a second stage to a sheet thickness of 0.08 mm, were annealed at a holding temperature of 300° C. for secondary intermediate annealing, then were cold rolled with a cold rolling rate of 44% to obtain a fin material of a final sheet thickness 45 μm (tempered: H14).

TABLE 3

Alloy Composition of Test Material (mass %)

| Alloy no. | Si | Fe | Cu | Mn | Zn | Al | (Si + Fe + 2Mn)/3 |
|---|---|---|---|---|---|---|---|
| 13 | 1.04 | 1.01 | 0.03 | 1.16 | 0.96 | bal. | 1.46 |
| 14 | 1.07 | 0.92 | 0.01 | 1.19 | 0.97 | bal. | 1.46 |
| 15 | 0.95 | 0.64 | 0.02 | 1.17 | 1.01 | bal. | 1.31 |
| 16 | 1.01 | 0.92 | 0.02 | 0.91 | 0.98 | bal. | 1.25 |
| 17 | 1.11 | 1.31 | 0.02 | 1.31 | 1.08 | bal. | 1.68 |
| 18 | 1.08 | 0.99 | 0.02 | 1.51 | 1.01 | bal. | 1.70 |
| 19 | 0.93 | 0.88 | 0.02 | 1.16 | 0.97 | bal. | 1.38 |
| 20 | 0.98 | 1.06 | 0.02 | 1.39 | 1.03 | bal. | 1.61 |

Fin materials of compositions of the alloy 13 to alloy 20 obtained above were tested and measured as in the following (1) to (3).

(1) Evaluation of Springback Before Brazing

Fin materials of the compositions of the alloys 13 to 20 obtained above were tested by a bending test of a fin plate (V-block method):

Bending angle: 90°

Radius of curvature of tip of pushing tool: R1.0 mm

Method of evaluation: The angle of a fin after a bending test was measured and return angle from the bending angle 90° was evaluated as springback. Note that in this Description, when the springback (return angle) is 8° or less, it is judged that the formability is excellent, while when the springback (return angle) is over 8°, it is judged that the formability is poor.

(2) Tensile Strength Before Brazing Heating (MPa)

The tensile strength was measured without brazing heating.

(3) Tensile Strength After Brazing Heating (MPa)

The following brazing heating conditions were used for heating and cooling, then the tensile strength was measured.

Brazing Heating Conditions

Envisioning the conditions of actual brazing heating, the material was raised in temperature from room temperature for 30 minutes, was held at 600 to 605° C. for 3 minutes, then was cooled down to 200° C. by a cooling speed of 40° C./min, then was taken out from the heating furnace and cooled down to room temperature.

Table 4 shows the results of measurement of (1) to (3) for fin materials of the compositions of the alloy 13 to alloy 20.

TABLE 4

Properties of Test Material

| Alloy no. | Springback (°) | Tensile strength before brazing (MPa) | Tensile strength after brazing (MPa) |
|---|---|---|---|
| 13 | 7.8 | 201 | 146 |
| 14 | 6.9 | 203 | 148 |
| 15 | 7.0 | 198 | 138 |
| 16 | 6.7 | 193 | 136 |
| 17 | 8.4 | 217 | 155 |
| 18 | 8.5 | 218 | 156 |
| 19 | 7.4 | 202 | 139 |
| 20 | 8.2 | 217 | 151 |

The fin material of the composition of the alloy 13 (invention example) was in the range of composition of the present invention, so had a tensile strength before brazing of 215 MPa or less, a springback of 8° or less or small, and a strength before brazing enabling easy fin formation.

The fin material of the composition of the alloy 14 (invention example) was in the range of composition of the present invention, so had a tensile strength before brazing of 215 MPa or less, a springback of 8° or less or small, and a strength before brazing enabling easy fin formation.

The fin material of the composition of the alloy 15 (comparative example) had a tensile strength before brazing of 215 MPa or less, a springback of 8° or less or small, and a strength before brazing enabling easy fin formation, but was too low in concentration of content of Fe, so had a tensile strength after brazing of less than 140 MPa or too low.

The fin material of the composition of the alloy 16 (comparative example) had a tensile strength before brazing of 215 MPa or less, a springback of 8° or less or small, and a strength before brazing enabling easy fin formation, but was too low in concentration of content of Mn, so had a tensile strength after brazing of less than 140 MPa or too low.

The fin material of the composition of the alloy 17 (comparative example) was too high in concentration of content of Fe, so had a tensile strength before brazing of over 215 MPa or too high, had a springback of over 8°, and did not have a strength before brazing enabling easy fin formation.

The fin material of the composition of the alloy 18 (comparative example) was too high in concentration of content of Mn, so had a tensile strength before brazing of over 215 MPa or too high, had a springback of over 8°, and did not have a strength before brazing enabling easy fin formation.

The fin material of the composition of the alloy 19 (comparative example) had a tensile strength before brazing of 215 MPa or less, a springback of 8° or less, and a strength before brazing enabling easy fin formation, but had a concentration of content of ([Si]+[Fe]+2[Mn])/3 of less than 1.4%, so had a tensile strength after brazing of less than 140 MPa or too low.

The fin material of the composition of the alloy 20 (comparative example) had a concentration of content of ([Si]+[Fe]+2[Mn])/3 of over 1.6%, so had a tensile strength before brazing of over 215 MPa or too high, had a springback of over 8°, and did not have a strength before brazing enabling easy fin formation.

INDUSTRIAL APPLICABILITY

As explained above, in a fin material obtained by using a thin slab continuous casting machine to continuously cast a thin slab, wind it up into a coil, then anneal and roll it to a final sheet thickness of 35 to 50 μm, by including Si: 0.9 to 1.2%, Fe: 0.8 to 1.1%, Mn: 1.1 to 1.4%, and Zn: 0.9 to 1.1%, further limiting the impurities Mg to 0.05% or less and Cu to 0.03% or less and the concentration of content of ([Si]+[Fe]+2[Mn])/3 to 1.4% to 1.6%, it is possible to obtain an aluminum alloy fin material for heat exchanger use which has a small springback, has a suitable strength before brazing enabling fin formation, have a high strength after brazing, and is excellent in mold wear characteristic, erosion resistance, self corrosion resistance, and sacrificial anodic effect.

The invention claimed is:

1. An aluminum alloy fin material for heat exchanger use containing, by mass %, Si: 0.9 to 1.2%, Fe: 0.8 to 1.1%, Mn: 1.1 to 1.4%, and Zn: 0.9 to 1.1%, further limiting the impurity Mg to 0.05% or less, Cu to 0.03% or less, and concentration of content of ([Si]+[Fe]+2[Mn])/3 to 1.4% to 1.6%, and having a balance of unavoidable impurities and Al, wherein a final sheet thickness is 35 to 50 μm, a tensile strength before brazing is 215 MPa or less, a solidus temperature is 620° C. or more, a tensile strength after brazing is 140 MPa or more, an electrical conductivity after brazing is 45% IACS or more, and a rest potential after brazing is −730 mV to −760 mV.

2. An aluminum alloy fin material for heat exchanger use according to claim 1, wherein an electrical conductivity after brazing is 45% IACS to 46.3% IACS or less.

3. An aluminum alloy fin material for heat exchanger use according to claim 1, wherein the final sheet thickness is 35 μm.

4. An aluminum alloy fin material for heat exchanger use according to claim 1, containing Zn of 0.95 to 1.1%.

5. An aluminum alloy fin material for heat exchanger use according to claim 1, containing Zn of 0.95 to 1.05%.

6. An aluminum alloy fin material for heat exchanger use according to claim 1, having a concentration of content of ([Si]+[Fe]+2[Mn])/3 of 1.46% to 1.53%.

7. A method of production of an aluminum alloy fin material for heat exchanger use according to claim 1, comprising pouring a melt of the composition according to claim 1, using a thin slab continuous casting machine to continuously cast a thickness 3 to 20 mm thin slab, using a hot rolling mill to roll the thin slab to 0.5 to 5 mm, winding it up in a roll, then cold rolling it to a sheet thickness of 0.05 to 0.1 mm, annealing it at a holding temperature of 250 to 450° C. for intermediate annealing, and cold rolling it with a final cold rolling rate of 25 to 50% to a final sheet thickness of 35 to 50 μm.

8. A method of production of aluminum alloy fins for heat exchanger use according to claim 1, comprising pouring a melt of the composition according to claim 1, using a thin slab continuous casting machine to continuously cast a thickness 3 to 10 mm thin slab, winding it up in a roll, then cold rolling it as a first stage to a sheet thickness of 1.0 to 6.0 mm, annealing it at 300 to 500° C. for primary intermediate annealing, further cold rolling it as a second stage to a sheet thickness of 0.05 to 0.1 mm, annealing it at 250 to 450° C. for secondary intermediate annealing, and cold rolling it with a final cold rolling rate of 25 to 50% to a final sheet thickness of 35 to 50 μm.

* * * * *